US007896182B1

(12) United States Patent
Hansen et al.

(10) Patent No.: US 7,896,182 B1
(45) Date of Patent: Mar. 1, 2011

(54) COATED-POLY CONTAINERS

(75) Inventors: Dean V. Hansen, Edgewood, MD (US); Jeffrey A. Gross, Nashport, OH (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 478 days.

(21) Appl. No.: 11/954,474

(22) Filed: Dec. 12, 2007

(51) Int. Cl.
*B65D 8/14* (2006.01)
*B65D 6/14* (2006.01)

(52) U.S. Cl. ..... 220/4.31; 220/62.22

(58) Field of Classification Search ..... 220/660, 220/4.01

See application file for complete search history.

(56) References Cited

U.S. PATENT DOCUMENTS 131,258 A * 9/1872 Evarts ..... 190/24
3,158,494 A * 11/1964 Eikvar et al. ..... 428/207
3,266,656 A * 8/1966 Kridle ..... 220/4.28
3,391,823 A * 7/1968 Tijms ..... 220/62.22
3,567,536 A * 3/1971 Wickersham, Jr. ..... 156/78
3,675,808 A * 7/1972 Brink ..... 220/7
3,951,190 A * 4/1976 Suter ..... 244/135 B
4,174,240 A * 11/1979 Muller et al. ..... 156/99
4,673,087 A * 6/1987 Webb ..... 206/600
5,259,523 A * 11/1993 Scherb ..... 220/4.26
5,593,058 A * 1/1997 Spencer et al. ..... 220/4.31
5,799,812 A * 9/1998 Mansouri ..... 220/4.31
2001/0022302 A1 * 9/2001 Dunn et al. ..... 220/62.11

* cited by examiner

*Primary Examiner* — Anthony Stashick
*Assistant Examiner* — Robert J Hicks
(74) *Attorney, Agent, or Firm* — Ulysses John Biffoni

(57) ABSTRACT

A container for facilitating bulk storage and transport of goods, which includes a top portion, a base portion, and a sidewall portion which define an interior cavity, and a polyurea layer of sufficient thickness adhering to and coating at least the exterior areas of the top, base and sidewall portions. The top, base, and sidewall portions are preferably composed of polystyrene. The sidewall portion further includes a plurality of panels, wherein each of the plurality of panels includes end portions configured for interlocking engagement with one another to form a rigid joint exhibiting tensile strength.

18 Claims, 5 Drawing Sheets

COATED-POLY CONTAINERS

GOVERNMENT INTEREST

The invention described herein may be manufactured, used and licensed by or for the U.S. Government.

FIELD OF THE INVENTION

The present invention relates to containers, and more particularly to a container exhibiting high strength, lightweight, and insulating properties adapted for facilitating safe bulk storage and transport of goods and cargo.

BACKGROUND OF THE INVENTION

Since the beginning of the American Revolutionary War, the United States Army has depended on the use of wooden boxes and crates to support its shipping, storage and logistic needs. Now, more than 230 years later, the U.S. Department of Defense still relies on the use of millions of wooden boxes and crates for supporting the same needs. Although wooden boxes and crates have provided useful service, they are generally expensive, heavy for the carry volume, and not environmentally friendly. Wooden boxes and crates are time consuming and labor intensive to assemble. They also do not offer a high degree of protection against the elements for the goods and cargo being stored or transported particularly against water/moisture and fluctuating temperature changes.

Such wooden boxes and crates including cleated plywood boxes are typically assembled by fastening wooden panels and lumber with nails, screws, strapping (poly or steel), and the like. The assembling process thus requires the use of additional materials/tools for fastening. The wooden box or crate may require disassembly to minimize space for subsequent re-use. The disassembly process is also time-consuming and labor intensive. The high cost and the time consuming nature of a carpenter built wooden box or crate further diminishes their ease of use and accessibility.

Corrugated cardboard materials are also used to make shipping containers. Such containers are relatively inexpensive, but are very easily damaged and have limited reusable capabilities. With cardboard boxes, if one of the sides is damaged, the structural integrity of the package is compromised. When the items to be packaged are heavy in weight or have a high density, the container must have a high bursting factor to support the stress (pounds per square inch) generated by this heavy weight. To obtain the proper high bursting factor, the container is reinforced either by double boxing, or by using boxes of double or triple wall thickness. This greatly reduces the carrying volume and significantly increases the weight of the box. Furthermore, cardboard boxes provide little or slight protection against the elements and must be kept dry to prevent disintegration.

Accordingly, there is a need to develop a container exhibiting high strength, lightweight, and insulating properties for facilitating safe bulk storage and transport of goods and cargo. There is a further need for a container that is cost effective and simple to fabricate and implement. There is a need for a container designed with enhanced bursting strength, exceptional stacking strength, low thermal conductivity, pierce-resistance, wear/abrasion-resistance, acid/corrosion-resistance, and enhanced carrying volume to weight ratio, while remaining relatively compact and lightweight.

SUMMARY OF THE INVENTION

The present invention relates generally to a container exhibiting high strength, lightweight, and insulating properties, and adapted especially for facilitating safe bulk storage and transport of goods and cargo. The container of the present invention is designed with enhanced bursting strength, exceptional stacking strength, low thermal conductivity, pierce-resistance, wear/abrasion-resistance, acid/corrosion-resistance, and enhanced carrying volume to weight ratio, while remaining relatively compact and lightweight. The robust structure of the container of the present invention further provides enhanced shock absorbing performance. The container of the present invention is further designed to effectively protect the goods and cargo contained therein from the external effects of the environment including passage of water/moisture and extreme temperature changes.

The container of the present invention comprises interlocking panels, sections or portions providing ease of assembly without the need for tools or the efforts of skilled personnel. The panels of the container are adapted to form tight joints exhibiting high tensile strength. The container of the present invention further includes a coating of polyurea extending over at least the exterior portions of the panels, which provides high exterior strength and exceptional performance. In a preferred embodiment of the present invention, the polyurea coating is a unitary layer covering at least substantially the entire exterior surface of the container. The container of the present invention can be readily recycled or re-used, thus further being environmentally friendly.

The container of the present invention is simple and cost effective to fabricate and implement. The container of the present invention is compact, lightweight and rugged, and can easily accommodate any goods or cargo. The container of the present invention is suitable for shipping and storage use and is especially suitable for use in the military sector, where extreme environments including battlefield and urban warfare conditions are typically encountered.

In one aspect of the present invention, there is provided a container for facilitating storage and transport of goods and cargo, comprising:

a top portion;

a base portion;

a sidewall portion, whereby the top and base portions are adapted for positioning the sidewall portion there between;

the top, base and sidewall portions further defining an interior cavity; and a polyurea layer of sufficient thickness adhering to and coating at least the exterior areas of the top, base and sidewall portions thereof.

In a further aspect of the present invention, there is provided a container for facilitating storage and transport of goods and cargo, comprising:

a top portion;

a base portion;

a sidewall portion, whereby the top and base portions are adapted for positioning the sidewall portion there between;

the top, base and sidewall portions further defining an interior cavity;

the sidewall portion comprises a plurality of panels, each of the plurality of panels includes end portions configured for interlocking engagement with one another to form a rigid joint exhibiting tensile strength there between; and a polyurea layer of sufficient thickness adhering to and coating at least the exterior areas of the top, base and sidewall portions thereof.

In another aspect of the present invention, there is provided a container for facilitating storage and transport of goods, comprising:

a top panel;

a base panel;

an opposing pair of side panels;

an opposing pair of end panels;

the pair of side panels and the pair of end panels each including means for interlocking opposing end portions with one another, whereby in the interlocked state the side and end panels form a rigid structure surrounding an interior storage volume with open top and bottom portions;

the base panel being adapted for receiving and closing off the open bottom portion of the interlocked pairs of side and end panels; and the top panel being adapted for receiving and closing off the open top portion of the interlocked pairs of side and end panels thereof.

BRIEF DESCRIPTION OF THE DRAWINGS

The following drawings are illustrative of embodiments of the present invention and are not intended to limit the invention as encompassed by the claims forming part of the application, wherein like items are identified by the same reference designations:

DETAILED DESCRIPTION OF THE INVENTION

The present invention relates generally to a container exhibiting high strength, lightweight, and insulating properties, and adapted especially for facilitating safe bulk storage and transport of goods and cargo. The container of the present invention is designed with enhanced bursting strength, exceptional stacking strength, low thermal conductivity, pierce-resistance, wear/abrasion-resistance, acid/corrosion-resistance, and enhanced carrying volume to weight ratio, while remaining relatively compact and lightweight. The robust structure of the container of the present invention further provides enhanced shock absorbing performance. The container, of the present invention is further designed to effectively protect the goods and cargo contained therein from the external effects of the environment including passage of water/moisture and extreme temperature changes.

The container of the present invention comprises interlocking panels, sections or portions providing ease of assembly without the need for tools or the efforts of skilled personnel. The panels of the container are adapted to form tight joints exhibiting high tensile strength. The container of the present invention further includes a coating of polyurea extending over at least the exterior, portions of the panels, which provides high exterior strength and exceptional performance. In a preferred embodiment of the present invention, the polyurea coating is a unitary layer covering at least substantially the entire exterior surface of the container. The container of the present invention can be readily recycled or re-used, thus further being environmentally friendly.

The container of the present invention is simple and cost effective to fabricate and implement. The container of the present invention is compact, lightweight and rugged, and can easily accommodate any goods or cargo. The container of the present invention is suitable for bulk shipping and storage use, and is especially suitable for use in the military sector, where extreme environments including battlefield and urban warfare conditions are typically encountered.

In one embodiment of the present invention, there is provided a container for facilitating storage and transport of goods, which includes a top portion, a base portion and a sidewall portion, whereby the top and base portions are adapted for positioning the sidewall portion there between, wherein the top, base and sidewall portions further define an interior cavity, and a polyurea layer of sufficient thickness adhering to and coating at least the exterior areas of the top, base and sidewall portions.

Figure 1:
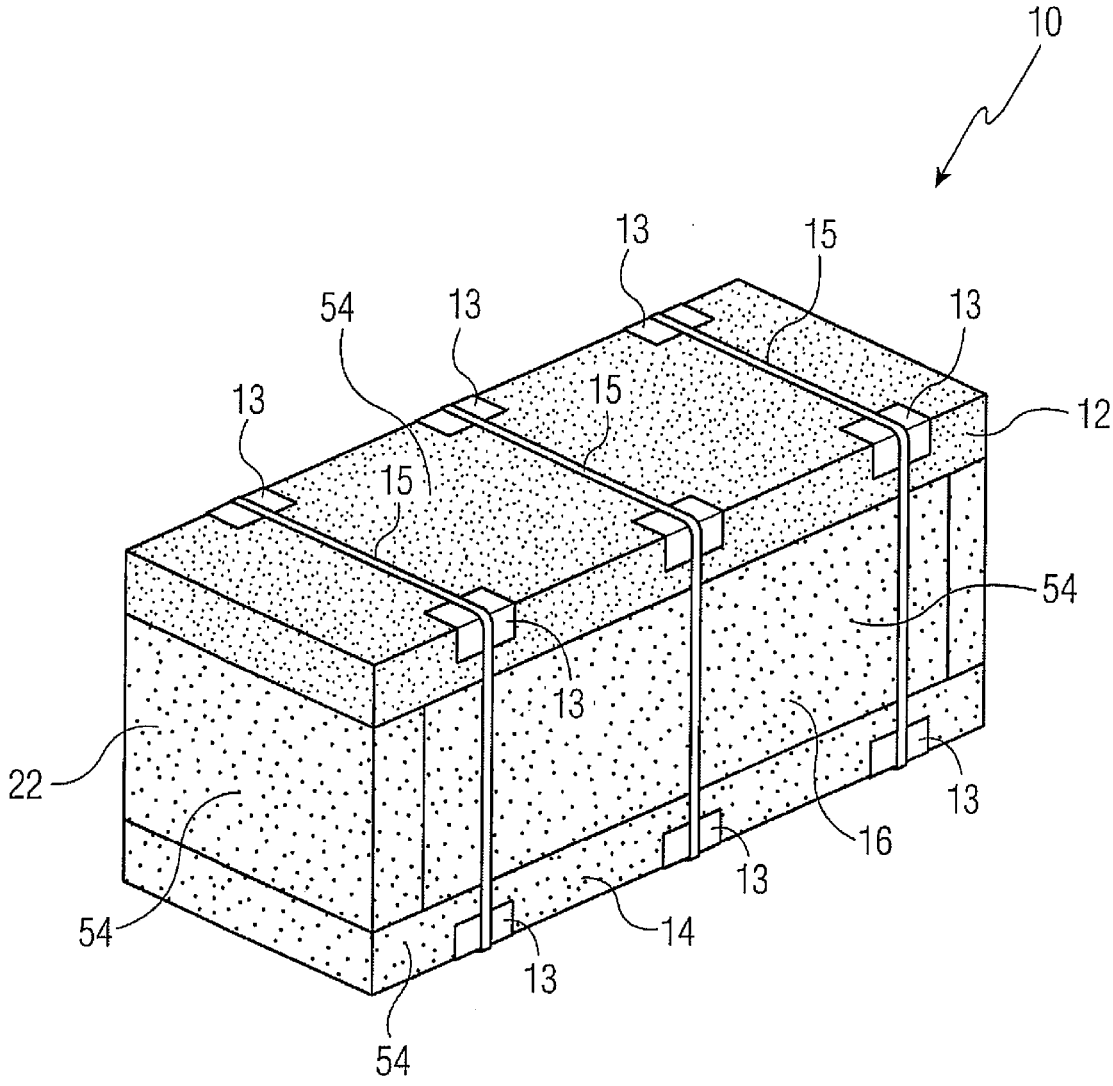
FIG. 1 is a perspective view of a container for facilitating bulk storage and transport of goods and cargo for one embodiment of the present invention.
Figure 2:
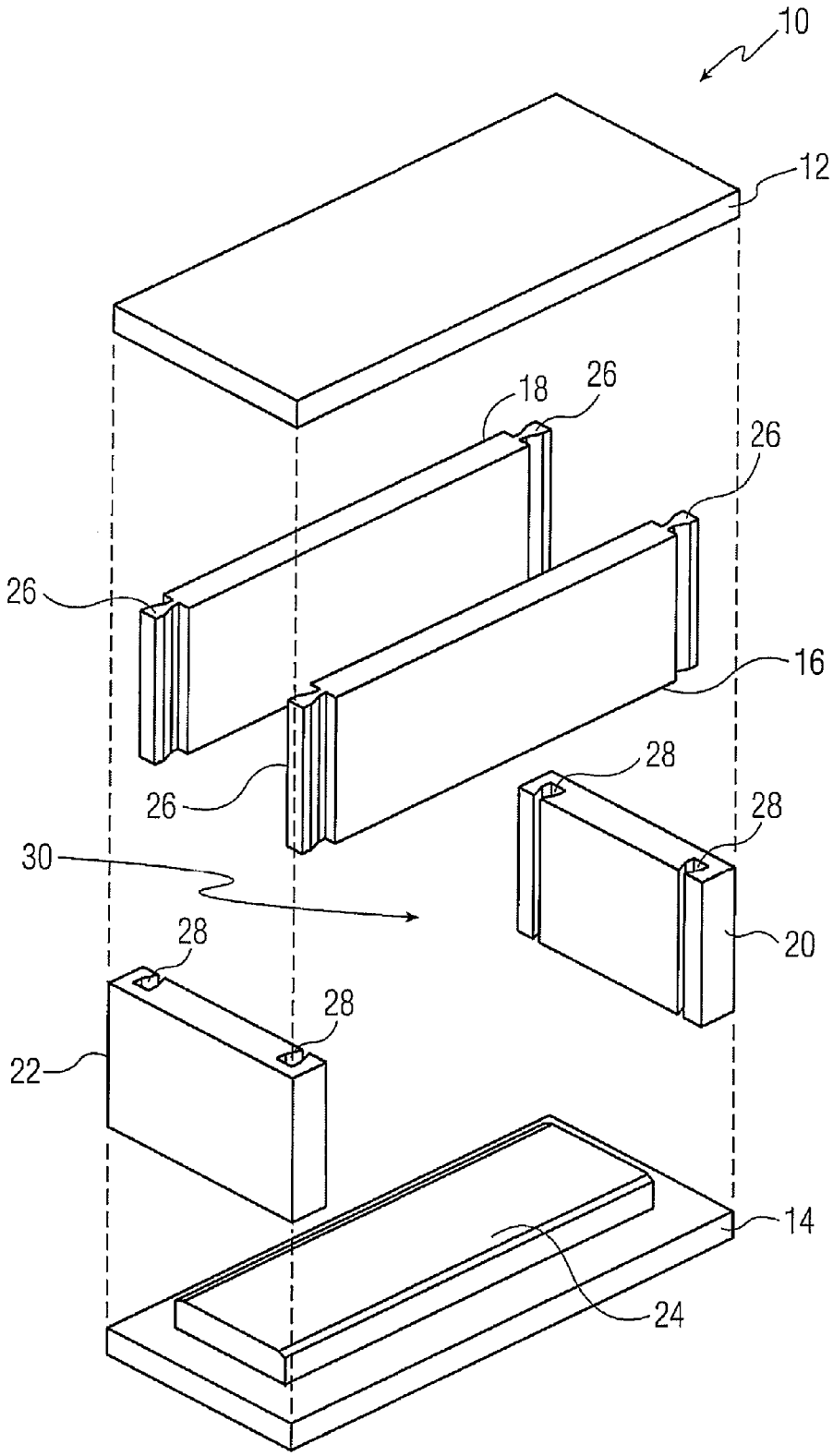
FIG. 2 is an exploded assembly view of the container in accordance with the present invention.
Figure 3A:
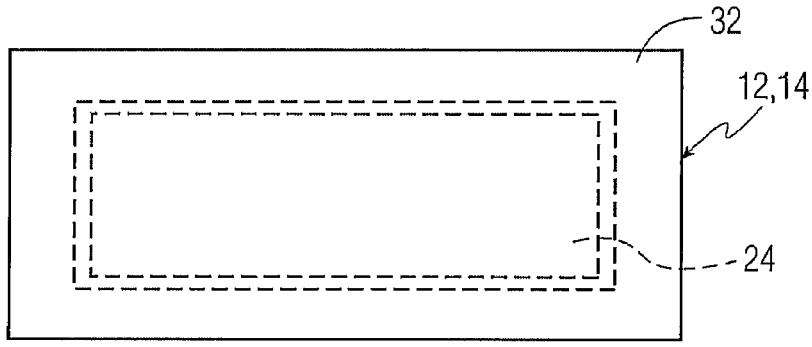
FIG. 3A is a plan view of an exterior side of a panel or portion for forming top and base portions of the container in accordance with the present invention.
Figure 3B:
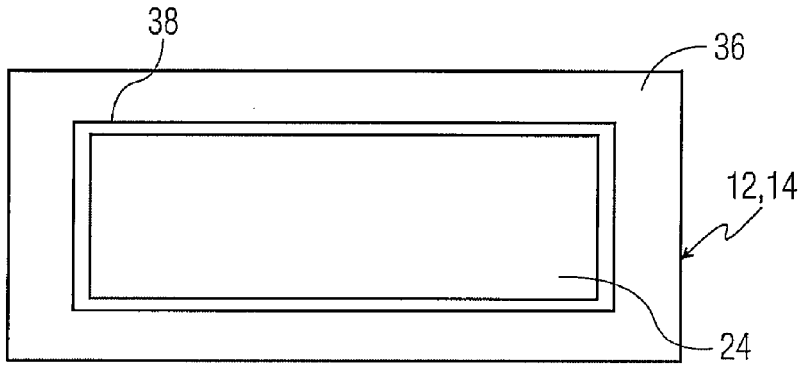
FIG. 3B is a plan view of an interior side of the panel of FIG. 3A in accordance with the present invention.
Figure 3C:
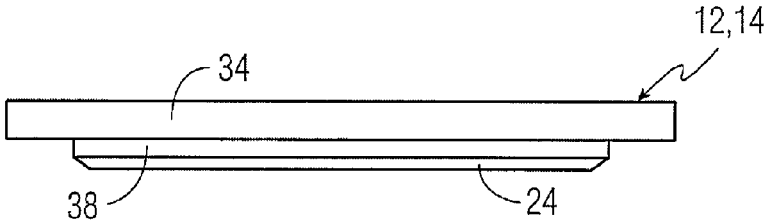
FIG. 3C is a side elevational view of the panel of FIG. 3A in accordance with the present invention.
Figure 3D:
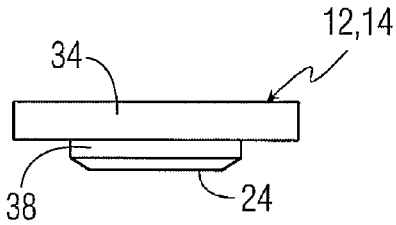
FIG. 3D is an elevational view looking from one end of the panel of FIG. 3A in accordance with the present invention.

Referring to FIGS. 1 and 2, a container 10 exhibiting high strength, lightweight, and insulating properties for safe storage and transport of goods and cargo, is shown for one embodiment of the present invention. The container 10 comprises a top panel or portion 12, a base panel or portion 14 located opposite from the top panel 12, a pair of opposing side panels or portions 16 and 18, and a pair of opposing end panels or portions 20 and 22. In this embodiment, only three types of panel components or portions are fabricated to implement the present invention.

The panels 12, 14, 16, 18, 20 and 22, in combination, define on the interior side thereof an inner cavity 30 (see FIG. 2) for securely accommodating and retaining goods and cargo, and include an outer surface on which adheres a layer 54 of a polyurea compound. The polyurea compound is generally a reaction product of an isocyanate component and a resin blend component comprising amine-terminated polymer resins and/or amine-terminated chain extenders. The polyurea layer 54 exhibits a sufficient thickness that adheres to and coats at least the exterior side of the panels 12, 14, 16, 18, 20 and 22.

In a preferred embodiment of the present invention, the polyurea layer 54 is a unitary layer covering at least substantially the entire exterior surface of the container 10. The polyurea layer 54 can extend across the joints between the joined panels 12, 14, 16, 18, 20 and 22 to enhance the structural integrity and strength and sealing properties of the container 10. Optionally, the joint between the top panel 12 and the remainder of the container 10 may remain unsealed to facilitate ease of access.

The polyurea layer 54 is applied to the exterior side of the container 10, and surface portions in contact with adjacent panels 12, 14, 16, 18, 20 or 22. The application of the polyurea layer 54 can be made prior to assembly of the container 10 or after assembly. Optionally, the polyurea layer 54 can be applied to the interior sides of the panels 12, 14, 16, 18, 20 and 22. To ensure proper adherence, the surface areas of the panels 12, 14, 16, 18, 20 and 22 is prepped and cleaned to remove contaminants. The polyurea layer 54 can be applied through any suitable means including spraying, dipping and the like. The polyurea layer 54 can further include a colorant to produce a desired color in the resulting container 10. Examples of such colors include black, olive drab green, desert sand, Navy gray or any other colors desired.

In a preferred embodiment of the present invention, the thickness of the polyurea layer 54 is at least 0.030 inch, and more preferably, ranging from about 0.030 inch to 0.080 inch. The cured stress/tensile is at least 2800 psi, and preferably from about 2800 psi to 3000 psi. The cured elongation at 25° C. is at least 350%, and preferably from about 350% to 375%. The cured hardness is about 90 Shore A. The cured tear strength ply is at least 400 PLI, and the cured impact notch is at least 65 ft-lb/inch. An example of a suitable polyurea product is InstaCote M-25, marketed by InstaCote, Inc. of Erie, Mich.

The end portions of the side panels 16 and 18 and the end panels 20 and 20 are configured for interlocking engagement with one another to form a rigid joint exhibiting tensile strength (i.e., resistance to being pulled apart) therebetween. The top and base panels 12 and 14, the side panels 16 and 18 and the end panels 20 and 22 are preferably composed of a foam-like polymer material, and more preferably selected from polystyrenes, polyethylenes, polypropylenes and combinations thereof. In a preferred embodiment of the present invention, the polymer material is in an extruded form. The panels 12, 14, 16, 18, 20 and 22 can be formed through, for example, sheet stamping and injection molding or hot wire cutting. The foam-like polymer material exhibits a density of at least 1.5 lbs per cubic foot, and preferably from about 2.8 to 3.2 lbs per cubic foot. The R or thermal value of the foam-like polymer material for the lower density material is at least 3.5 R-Value per every inch thickness. It is noted that as the density of the material increases, the R value decreases. It is further noted that as the density of the polymer material increases, the strength of the container 10 increases.

Optionally, the container 10 can further comprise at least one strap fasteners 15 in the form of a flat metal strapping for securing the closure of the container 10, and a plurality of corner protectors 13 located at each corner areas of the container 10 to ensure proper placement of the strap fasteners 15. It will be understood that the present invention is not limited to strap fasteners for securing closure, and that other securing mechanisms can also be used as known to one skilled in the art.

Each of the top and base panels 12 and 14, the side panels 16 and 18, and the end panels 20 and 22 are configured to fit and couple with one another to form a stable, and interlocking structure. As shown in FIG. 2, the top and base panels 12 and 14 include a stepped protrusion 24 centrally located on the interior side thereof. The stepped protrusion 24 slightly projects into the interior cavity 30 to provide a snug fit with the assembled structure of the side panels 16 and 18, and the end panels 20 and 22 as will be described hereinafter.

The side panels 16 and 18, each include a pin or projection 26 extending from opposing ends thereof. The end panels 20 and 22 each include a corresponding tail or groove 28 cut into the interior surface at the end portions thereof. The pins 26 and the tails 28 can be formed through any suitable means including, but not limited to, shaping and cutting via hot-wire foam cutting, 3- and 5-axis routers, or molding. The pins 26 of the side panels 16 and 18 are configured to snugly fit into the corresponding tails 28 of the end panels 20 and 22 to form a dovetail joint. The dovetail joint can be selected from a through dovetail joint, a half-blind dovetail joint, a sliding dovetail joint, a full-blind dovetail joint, and any combinations thereof. In a preferred embodiment, the dovetail joint is a sliding dovetail joint.

Referring to FIGS. 3A-3D, the top and base panels 12 and 14 are shown for one embodiment of the present invention. Each of the top and base panels 12 and 14 is rectangular in shape, and includes the stepped protrusion 24 located central on the interior side thereof. The polyurea layer 54 is generally applied to coat a top surface 32, edge surfaces 34 and a flange surface 36 of the top and base panels 12 and 14. The stepped protrusions 24 of the top and base panels 12 and 14 provide a snug fit and sealing contact with the assembled side panels 16 and 18 and the end panels 20 and 22 as shown in FIG. 1. Optionally, a bead of sealant can be applied to edge portions 38 along the periphery of the stepped protrusion 24 to further enhance sealing contact and provide a small interference fit.

Figure 4A:
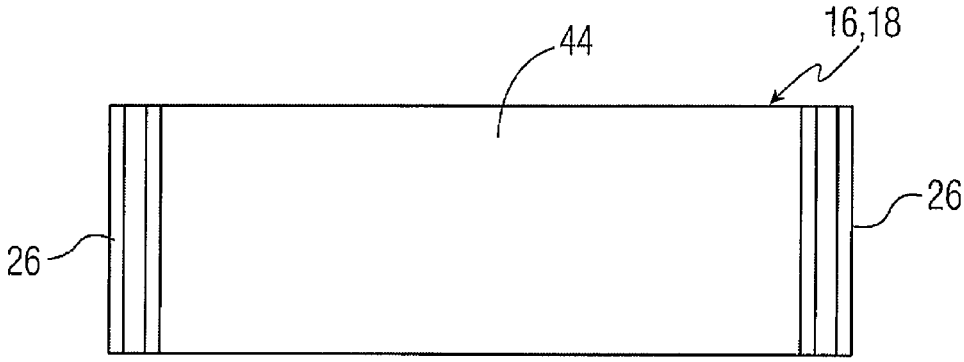
FIG. 4A is a side elevational view of a side panel or portion for forming side portions of the container in accordance with the present invention.
Figure 4B:
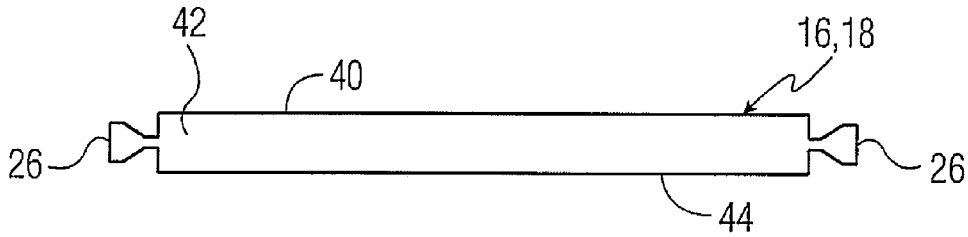
FIG. 4B is a plan view of the side panel of FIG. 4A in accordance with the present invention.
Figure 4C:
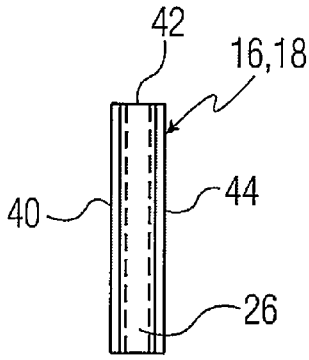
FIG. 4C is an elevational view looking from one end of the side panel of FIG. 4A in accordance with the present invention.

Referring to FIG. 4A-4C, the side panels 16 and 18 are shown for one embodiment of the present invention. Each of the side panels 16 and 18 is rectangular in shape, and includes the pins or projections 26 extending from opposing ends thereof. The polyurea layer 54 is generally applied to coat an outer surface 40 and an edge surface 42 of the side panels 16 and 18. Optionally, the polyurea layer 54 can be applied to coat an inside surface 44.

The pins 26 of the side panels 16 and 18 are adapted to fit into and mate with the corresponding tails 28 of the end panels 20 and 22 (see FIG. 5B) to form a snug fit joint therebetween. The pins 26 and the tails 28 are trapezoidal in shape, and configured to fit together with no gap therebetween so that the joint interlocks tightly with no movement. The resulting joint forms a sliding dovetail joint. The angle of the slope of the trapezoid can range depending on the hardness of the side panels 16 and 18 and the end panels 20 and 22, and the slope can range from 1:6 to 1:8, and preferably 1:7.

Figure 5A:
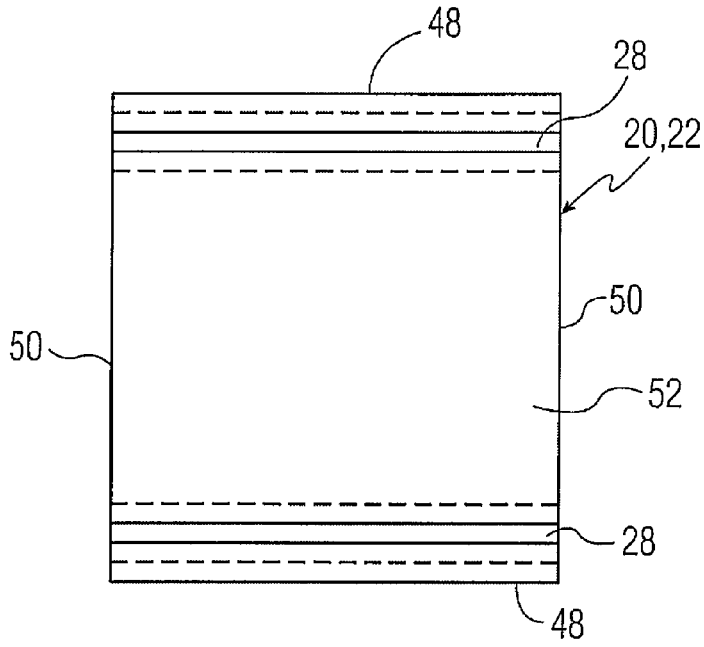
FIG. 5A is an elevational view of an interior side of an end panel or portion for forming end portions of the container in accordance with the present invention.
Figure 5B:
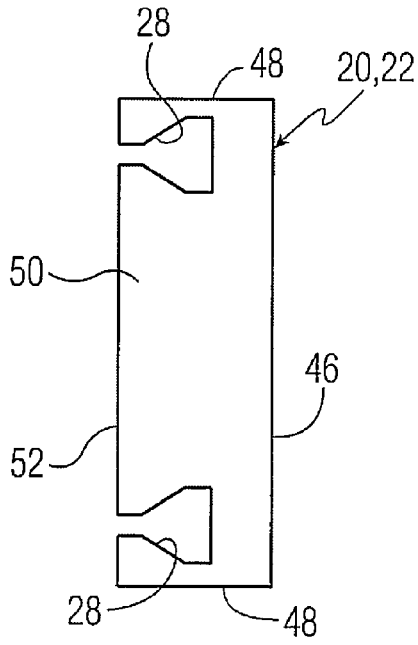
FIG. 5B is a top plan view of the end panel of FIG. 5A in accordance with the present invention.

Referring to FIGS. 5A and 5B, the end panels 20 and 22 are shown for one embodiment of the present invention. Each of the end panels 20 and 22 is rectangular in shape, and includes the tails 28 located proximate the ends on the interior side thereof. The end panels 20 and 22 further include an outer surface 46, side surfaces 48, top and bottom surfaces 50, and an inside surface 52. The polyurea layer 54 is generally applied to coat the outer surface 46, the side surfaces 48, the top and bottom surfaces 50 of the end panels 20 and 22. Optionally, the polyurea layer 54 can be applied to coat the inside surface 52. The tails 28 of the end panels 20 and 22 are each in the form of a straight groove extending between the top and bottom surfaces 50, and are adapted to fit into and mate with the corresponding pins 26 of the side panels 16 and 18 (see FIGS. 4A to 4C) to form a snug fit joint therebetween.

With references to FIGS. 1 through 5B, the container 10 can be readily assembled in a simple manner. The top panel 12 is prepped and cleared of contaminants on the surface, and may be pre-coated with the polyurea layer 54 over the areas previously described above. The top panel 12 is set aside to allow the polyurea layer 54 to properly dry and cure. The base panel 14 is placed flat with the stepped protrusion 14 extending upward. Each of the end panels 20 and 22 are placed on the flange portion 36 and abutting against the edge portion 38 of the base panel 14, respectively, with the tails 28 facing towards one another. Each of the side panels 16 and 18 are placed on the flange portion 36 of the base panel 14 with the pins 26 sliding into the corresponding tails 28 of the end panels 20 and 22.

Once assembled, the panels 14, 16, 18, 20 and 22 form a bottom structure of the container 10. The bottom structure of the container 10 is prepped and cleared of contaminants on the surface. The polyurea layer 54 is applied as a unitary coating to the exterior portions of the bottom structure of the container 10. The polyurea layer 54 securely retains the corresponding panels 14, 16, 18, 20 and 22 to one another, thus enhancing tensile strength and rigidity therebetween. The coated bottom structure is set aside to allow the polyurea layer 54 to properly dry and cure.

Once the polyurea layer 54 is fully cured, the pre-coated top panel 12 is placed on top of the bottom structure formed by the coupled bottom, side and end panels 14, 16, 18, 20, and 22, with the stepped protrusion 24 inserted into the interior cavity 30 to form the container 10. Optionally, a bead of sealant such as silicone can be applied around the sealing edge portions 38 of the top and base panels 12 and 14 to provide a small interference fit to seal the container 10 and/or along the inside seams or joints of the container 10 after assembly. The corner protectors 13 are placed at the corner portions of the top and base panels 12 and 14, and the strap fasteners 15 are affixed around the container 10 on the corner protectors 13 for securing closure of the container 10.

EXAMPLE

Test Study and Results for Container of the Present Invention

A test study was implemented to test and evaluate four test containers (two containers, one of each density tested to ASTM D 4169 DC-18, and two containers one of each density stack tested to 30,000 lb or failure whichever occurs first). The test containers were constructed and packaged as specified below.

A sample size of four test containers (two containers for ASTM D 4169 DC-18 Schedule H and F testing, and two containers for ASTM D 4169 DC-18 Schedule B stack to failure testing) was delivered in a new untested condition to the PSCC Testing Lab for ASTM D4169 Distribution Cycle 18 testing.

These test containers included a bead of silicon added to the test containers top where it contacts the inside edge of the test container when closed. The test containers were designed for use as a Level A shipping container for ground and air transportation of Carrier Assay Assemblies, Assay Strips.

The test containers were developed in accordance with military handling requirements to include: preservation, packing, unitization, and marking. The Carrier Assay Assemblies required passive temperature control for shipment. Carrier Assay Assemblies are sensitive to extreme temperature conditions including freezing temperatures and elevated temperatures. One of the requirements for the test containers is protection of the Carrier Assay Assemblies from extreme temperature for about 72 hours.

Two test containers of different densities were packaged at the testing facility and banded. The test containers were pre-numbered by the customer (ID and density numbers) and used throughout the test for identification of results. The test container ID, dimensions, and weights are shown in Table 1 below.

TABLE 1

| Test Container ID Number | Exterior Container Dimensions | Density |
|---|---|---|
| 1 | 40 × 23½ × 14½ | 4# |
| 2 | 40 × 23¼ × 14½ | 3# |
| 3 | 40 × 23½ × 14½ | 4# |
| 4 | 37¼ × 21 × 13¾ | 3# |

*Note: All dimensions are in inches

All weights are gross and in pounds except 1 and 4 which are tare weights

The Carrier Assay Assemblies were packaged and cushioned in their individual fiberboard containers, and then in water vapor proof bags along with desiccant packs. A temperature indicator was placed in the interior of the containers to alert whether the Carrier Assay Assemblies has been exposed to temperature environments beyond the limits of the Carrier Assay Assemblies. The individually packed Carrier Assay Assemblies were placed in a 3 to 4-lb density polyethylene containers having a removable lid. The exterior surfaces and interior top edges of the test containers were sprayed with a commercially available polyurea product. The inside surface of the lid and interior of the packaging remained unsprayed in its original extruded condition. A bead of silicon was placed around the entire inside of the top edge of the removable top, where contact is made with the inside edge of the test container when closed. Closure/sealing was accomplished using three pieces of ¾"×0.023" steel banding.

All testing was performed in the PSCC container laboratory with ambient conditions ranging from 70 to 74 degrees Fahrenheit and 43 to 56 percent Relative Humidity unless stated otherwise. A Tenney Environmental Walk-in T/H chamber, Model WITR, Calibration expiration date 14 Mar. 2008, was used for conditioning. Temperature and humidity were recorded using a Honeywell DR 4300 chart recorder and controlled with a Tenney Versa Tenn III controller.

The test containers were inspected for damage as received prior to testing. The number 2 and 3 test containers used for schedule H and F testing were packaged (gross weight of 57 lb) by the customer according to an established government SPI at the PSCC container laboratory. On completion of packaging, the test containers were placed into a T/H walk-in chamber and conditioned in accordance with ASTM D 4332, in standard conditions (73.4° F.±1.4°, 50% RH±5%) for a minimum of 72 hours prior to testing.

The test containers were tested in accordance with requirements of ASTM D 4169-05, schedules H, F, and B per Distribution Cycle 18, Quality Assurance Level I (Level A Military packaging per MIL-STD-2073-1D), Acceptance criteria 1 for Small Shipping Containers. Small shipping containers are defined as one having no edge dimension or diameter over 60 inches and a gross weight of 150 lb or less. The test schedule is shown in Table 2 below.

TABLE 2

| Distribution | Sequence | | |
|---|---|---|---|
| Cycle | First | Second | Third |
| 18 | Schedule H | Schedule F | Schedule B (Destructive) See note |

Note: The third sequence was added to the test requirements per the customers request and was not part of the original DC-18. The containers used for the DC-18 testing were inspected for condition of container, and banding, after sequence two, then opened and inspected for moisture/water leakage, and rated.

The acceptance criteria at the completion of the test included compliance with Criterion 1 of ASTM D 4169 and protection of the Carrier Assay Assemblies against damage. Although both of these test containers have a re-usable application for other products they will not be used as re-usable test containers in the JBPDS life cycle. Minor damage or minor blemishes to the test containers may be allowed at the discretion of the government as long as these conditions do not affect the performance of the test container or its expected life as a non-reusable test container as used in this application. Pass, Fail ratings were given for each test.

The summary of the tests conducted and the results are shown in Table 3 below.

TABLE 3

| Test Performed | Results of Test |
|---|---|
| Environmental Hazards test (ASTM D 4169 Schedule H first sequence) | Pass |
| Loose load Vibration test (ASTM D 4169 Schedule F fifth sequence) | Pass |
| Warehouse Stacking test (Modified ASTM D 4169 Schedule B fifth sequence) (Destructive) | N/A for comparison only |

Testing procedures were conducted on the loaded test containers in the following sequence with results included for each procedure.

Schedule H, (Environmental Hazards) Fourth Sequence determines the susceptibility of the total pack to the effects of moisture, temperature shock, or the combined effects of cyclic exposure. The Environmental Hazards test was implemented over a four-day testing period. A Tenney Environmental walk-in chamber with a Watlow 920 series controller and Honeywell model 9500 chart recorder was used to accomplish the temperature exposure of the testing, and Packaging Rain Room (with water recycling system capable of up to 6 inches of rainfall per hour).

The environmental test was performed in accordance with ASTM D 4169 para 15.1-15.2 and Test Method D 951-99, where spray intensity of; 4+1 inches per hour is used for Assurance Level I. Rainfall levels were recorded using a LaCrosse model WS-7048U Rain. Meter (self calibrating). Testing was performed at ambient conditions of 70°-74° F. & 43-56% RH. The test levels used to perform this test is shown in Table 4 below.

TABLE 4

| Environmental Test Levels | | |
|---|---|---|
| | DC-18 Assurance Level II | |
| Temperature (° F.) | Water Spray | Duration Hours |
| 130 | | 16 |
| 60 | X | 2 |
| −10 | | 2 |
| 130 | X | 2 |
| 60 | X | 2 |
| 50 | | 16 |
| 130 | | 4 |
| 60 | X | 2 |
| 50 | | 2 |
| 130 | | 16 |
| 60 | X | 2 |
| −10 | | 2 |
| 50 | | 3 |
| 130 | | 16 |

After the environmental testing was completed the test containers were weighed and examined for damage. The average weight gain per container after environmental exposure was approximately 4 lb. The test containers were palletized (for ease of handling/transportation) on their sides (to check for excessive water inside) prior to vibration testing. Although the test containers leaked at the sealed top edges there was no excessive water runout from inside. A PASS was given for this test.

The test levels and test methods for Schedule F (Loose Load Vibration) Fifth Sequence of the distribution cycle were intended to determine the ability of shipping units to withstand the vertical vibration environment during transport. The test levels and methods account for the magnitude, frequency range, duration, and direction of vibration. The Loose Load Vibration test was implemented at ambient conditions of 70° F. & 56% RH. Vibration tests were conducted on the loaded test container as specified in ASTM D 999-01 Method A2, Repetitive Shock Test (Rotary Motion).

This test was conducted on an L.A.B. Model 2000V, 2,000-pound capacity and Model 1250V, 1250-pound capacity vibration table, with the double amplitude displacement of the vibration table fixed at one inch. The test ran for a total of three hours (per test container). The test containers were vibrated for 90 minutes in the longitudinal orientation (test container end to left), then rotated 90 degrees and vibrated for 90 minutes in the lateral orientation (test container end to front). Table 5 shows the RPM/Hz required for liftoff of the different test containers.

TABLE 5

| Test container ID number | Container Nomenclature | RPM/Hz Longitudinal | RPM/HZ Lateral |
|---|---|---|---|
| 2 | Poly | 240/4 | 235/3.91 |
| 3 | Poly | 240/4 | 235/3.91 |

There was minor scuffing of all four tested containers bottoms caused by the rotary motion of the vibration table and friction of the package on the table's platform. There was no other visible damage. A PASS rating was given for this test.

At the completion of sequence two, the two tested were opened and assessed for damage. When opened and unpacked, test container 2 was dry inside but there was a slight feeling of moisture present on the bottom of the intermediate packagings. The intermediate packagings were damage free and were not opened due to their condition. Upon opening and unpacking it was concluded that the seals (silicon bead) on both test containers had slight leaks contributing to the 4 lb gain in container weight (test container 3 was a bit damper than test container 2 and had a few small droplets of water inside due to the environmental exposure testing). The outside of the test container showed no splits or other damage as did the inside. Both test containers were given a PASS rating at test completion.

The purpose of Schedule B, Warehouse Stacking Third Sequence (destructive) was to determine the structural strength of the test containers in relationship to each other. The test container was manufactured from polyethylene materials and coated with a polyurea material. The test container with the sprayed on polyurea coating was proposed to reduce cost, provide better water-proof protection, provide thermal protection (when required) and reduce weight of the current pack. This test container has military applications far beyond the current configuration.

In the Stacking Test, a static load of 30,000 lb was placed on each test, container (empty) until failure. The test was implemented for strength comparison only. This test was conducted on a Gaynes Model 30KCT Compression Tester with a 30,000 pound compressive limit. Calibration expiration date is April 2007. Testing was performed at ambient conditions of 72° F. & 43% RH. Stacking test of the test containers was performed in accordance with Test Method ASTM D 642-00 and ASTM D 4169-04a para 11.3. The test container ID and stack weights used for testing are shown in Table 6 below.

TABLE 6

| Test container ID Number | Exterior Container Dimensions | Container Density | Stack (weight) |
|---|---|---|---|
| 1 | 37¼ × 21 × 13¾ | 4# | 30,000 lb |
| 4 | 37¼ × 21 × 13¾ Complete sprayed on coating inside and outside | 3# | 30,000 lb |

Note: All dimensions are in inches

As shown in Table 7 below, the test containers reached peak loads of 12,508 lb and 17,490 lb before losing structural strength, causing the sidewalls to bow. The lid of the test containers was critical in adding to its strength absorbing most of the compression (approx. 0.75 inches) observed during testing.

TABLE 7

| Test container ID Number | Exterior Container Dimensions (in.) | Container Density | Peak Load (lbs.) | Deflection (in.) |
|---|---|---|---|---|
| 1 | 371/4 x 2 1 x 13% | 4# | 12,508 | .95 |
| 4 | 371/4 x 2 1 x 13% | 3# | 17,490 | .85 |

It can be concluded from the results of testing that there is still a small problem sealing the test container tops but considerable progress was made as indicated by the weight gain seen during environmental exposure testing which showed less than half the weight gain experienced during testing on similar container without the silicon bead (seal) added.

The polyurea coating added to the interior top edge added structural strength to the test container preventing the inner cracking and separations seen in the previous testing of the same container design during stack to failure of the container. The test containers used in the packaging of the Carrier Assay Assemblies, Assay Strips are durable and would be an acceptable replacement for cleated panel board boxes as a shipping container used for shipment of the parts, thus reducing the cost of packaging and shipping to the government. Recommendations include different placement of the silicon beading on the test container tops along with a different banding pattern to prevent the induction of water/moisture to the interior of the test containers.

The forgoing discussion discloses and describes merely exemplary embodiments of the present invention. One skilled in the art will readily recognize from such discussion, and from the accompanying claims, that various changes, modifications, and variations can be made therein without departing from the spirit and scope of the invention as defined in the following claims. For example, side panels 16 and 18 can alternatively be square in shape, as can be the end panels 20 and 22, and the top and base panels 12 and 14.

What is claimed is:

1. A container for facilitating storage and transport of goods, comprising:

a top portion;

a base portion;

a sidewall portion, whereby said top and base portions are adapted for positioning said sidewall portion therebetween;

said top, base and sidewall portions further defining an interior cavity;

wherein said top, base and sidewall portions are composed of a polymer material selected from the group consisting of polystyrene, polyethylene, polypropylene, and combinations thereof; and a polyurea layer of thickness in the range of from about 0.030 inch to about 0.080 inch adhering to and coating at least the exterior areas of the top, base and sidewall portions thereof.

2. The container of claim 1, wherein the polymer material comprises polystyrene.

3. The container of claim 1, further comprising means for securing said top portion and said bottom portion to said sidewall portion.

4. The container of claim 3, wherein said securing means comprises a strapping material.

5. The container of claim 1, wherein the sidewall portion comprises a plurality of panels, each of said plurality of panels includes end portions configured for interlocking engagement with one another to form a rigid joint exhibiting tensile strength therebetween.

6. The container of claim 5, wherein the joint comprises at least one pin extending from the end portion of one section and at least one corresponding tail cut into the end portion of an adjacent section.

7. The container of claim 5, wherein the joint is a dovetail joint.

8. The container of claim 7, wherein the dovetail joint is selected from the group consisting of a through dovetail joint, a half-blind dovetail joint, a sliding dovetail joint, a full-blind dovetail joint, and combinations thereof.

9. The container of claim 8, wherein the dovetail joint is in the form of a sliding dovetail joint.

10. The container of claim 1, wherein the polyurea layer is in the form of a single unitary coating extending over at least the exterior areas of the base and sidewall portions thereof.

11. A container for facilitating storage and transport of goods, comprising:

a top portion;

a base portion;

a sidewall portion, whereby said top and base portions are adapted for positioning said sidewall portion there between;

said top, base and sidewall portions further defining an interior cavity, and wherein the sidewall portion comprises a plurality of panels, each of said plurality of panels includes end portions configured for interlocking engagement with one another to form a rigid joint exhibiting tensile strength therebetween;

wherein and sidewall portions are composed of a polymer material selected from the group consisting of polystyrene, polyethylene, polypropylene, and combinations thereof; and a polyurea layer of thickness in the range of from about 0.030 inch to about 0.080 inch adhering to and coating at least the exterior areas of the top, base and sidewall portions thereof.

12. The container of claim 11, wherein the polyurea layer is in the form of a single unitary coating extending over at least the exterior areas of the base and sidewall portions thereof.

13. The container of claim 11, further comprising means for securing said top portion and said bottom portion to said sidewall portion.

14. The container of claim 13, wherein said securing means comprises a strapping material.

15. The container of claim 11, wherein said joint comprises at least one pin extending from the end portion of one section and at least one corresponding tail cut into the end portion of an adjacent section.

16. The container of claim 11, wherein the joint is a dovetail joint.

17. A container for facilitating storage and transport of goods, comprising:

a top panel;

a base panel;

an opposing pair of side panels;

an opposing pair of end panels;

said pair of side panels and said pair of end panels each including means for interlocking opposing end portions with one another, whereby in the interlocked state the side and end panels form a rigid structure surrounding an interior storage volume with open top and bottom portions;

said base panel being adapted for receiving and closing off the open bottom portion of the interlocked pairs of side and end panels;

said top panel being adapted for receiving and closing off the open top portion of the interlocked pairs of side and end panels; and wherein said top, base, side, and end panels are composed of a polymer material selected from the group consisting of polystyrene, polyethylene, polypropylene, and combinations thereof; and a polyurea layer of thickness in a range of from about 0.030 inch to about 0.080 inch adhering to and coating at least the exterior areas of the top, base, side, and end panels thereof.

18. The container of claim 17, wherein the polyurea layer is in the form of a single unitary coating extending over at least the exterior areas of the base, side and end panels thereof.

* * * * *